US006393997B1

(12) United States Patent
Vande Sande

(10) Patent No.: US 6,393,997 B1
(45) Date of Patent: May 28, 2002

(54) AERATOR PAD ASSEMBLY FOR RAILWAY HOPPER CARS

(75) Inventor: Jerry W. Vande Sande, Southlake, TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/528,208

(22) Filed: Mar. 17, 2000

Related U.S. Application Data

(60) Provisional application No. 60/125,371, filed on Mar. 18, 1999.

(51) Int. Cl.[7] ..... B65G 69/06

(52) U.S. Cl. ..... 105/247; 277/630; 222/195; 209/411

(58) Field of Search ..... 105/247; 277/192, 277/630, 637, 650, 651; 222/195, 189, 542; 49/494; 209/405, 411, 421, 408

(56) References Cited

U.S. PATENT DOCUMENTS

| | | | | |
|---|---|---|---|---|
| 1,422,133 A | | 7/1922 | Robider | |
| 1,982,759 A | * | 12/1934 | Rosen | 277/651 |
| 2,089,347 A | | 8/1937 | Dondlinger | 214/83 |
| 2,274,708 A | | 3/1942 | Kennedy | 302/53 |
| 2,950,143 A | | 8/1960 | Koranda et al. | 302/52 |
| 3,088,776 A | | 5/1963 | Aller | 302/52 |
| 3,177,042 A | | 4/1965 | Borger et al. | 302/58 |
| 3,252,431 A | | 5/1966 | Phillips | 105/360 |
| 3,339,499 A | | 9/1967 | Charles et al. | 105/248 |
| 3,343,888 A | | 9/1967 | Anderson et al. | 302/52 |
| 3,420,419 A | | 1/1969 | Haslett, Jr. | 222/544 |
| 3,583,330 A | | 6/1971 | Freudman et al. | 105/239 |

(List continued on next page.)

FOREIGN PATENT DOCUMENTS

| | | | |
|---|---|---|---|
| CA | 844874 | 6/1970 | 105/123 |
| CA | 1015007 | 8/1977 | 302/33 |
| CA | 1101021 | 5/1981 | 302/17 |
| CA | 1149230 | 7/1983 | 105/123 |
| CA | 1156513 | 11/1983 | 105/123 |
| CA | 1165182 | 4/1984 | 105/123 |
| CA | 1174114 | 9/1984 | 105/122 |
| DE | 3402895 A1 | 8/1984 | B65G/67/24 |

OTHER PUBLICATIONS

North American Car Corp. brochure, "The Unique Car, A Totally Flexible Distribution System for Dry Flowable Products," No date.

Trinity Industries, Inc. Operating brochure, "Power Flow" (PF/RSB–3M–6/88), 1988.

Solimar brochure, "Pneumatic Systems for Dry Bulk Trailers, Railway Cars and Storage Silos", No date.

(List continued on next page.)

*Primary Examiner*—S. Joseph Morano
*Assistant Examiner*—Frantz F. Jules
(74) *Attorney, Agent, or Firm*—Baker Botts L.L.P.

(57) ABSTRACT

An aerator pad assembly having an aeration pad with a number of cutouts forming a shaped perimeter, is provided. The aeration pad may include a number of supports providing which provide air flow paths between the aeration pad and an associated aeration panel. A gasket may be disposed about the shaped perimeter, the gasket having a plurality of protuberances with fastener openings included, and the protuberances preferably cooperate with the cutouts to form a generally continuous interface between them. In one embodiment, a notched opening within the gasket is provided at the generally continuous interface with the shaped perimeter at least partially occupying a portion of the notched opening. In a particular embodiment, the gasket may be molded onto the aeration pad. In another embodiment, an adhesive material may be provided to form the attachment. In yet another embodiment, stitches of thread may attach the gasket and the aeration pad. A sealant material may also be provided at the generally continuous interface to seal voids between the gasket and the pad.

20 Claims, 5 Drawing Sheets

U.S. PATENT DOCUMENTS

| | | | | | |
|---|---|---|---|---|---|
| 3,583,331 | A | | 6/1971 | Mowatt-Larseen | 105/360 |
| 3,639,007 | A | | 2/1972 | Dare et al. | 302/52 |
| 3,708,209 | A | | 1/1973 | Dugge | 302/52 |
| 3,778,114 | A | | 12/1973 | Carney et al. | 302/52 |
| 3,837,497 | A | | 9/1974 | Smith | 210/349 |
| 3,929,261 | A | | 12/1975 | Solimar | 222/195 |
| 4,082,365 | A | | 4/1978 | Dugge et al. | 302/52 |
| 4,101,175 | A | | 7/1978 | Kull | 302/53 |
| 4,106,749 | A | | 8/1978 | Behle | 351/144 |
| 4,151,935 | A | | 5/1979 | Dugge | 222/556 |
| 4,165,820 | A | | 8/1979 | Dugge et al. | 222/70 |
| 4,189,262 | A | | 2/1980 | Anderson | 406/136 |
| 4,194,450 | A | | 3/1980 | Miller | 105/253 |
| 4,227,732 | A | | 10/1980 | Kish | 294/71 |
| 4,254,714 | A | | 3/1981 | Heap | 105/406 R |
| 4,280,706 | A | | 7/1981 | Vorwerk | 277/12 |
| 4,286,524 | A | | 9/1981 | Jantzen | 105/248 |
| 4,352,331 | A | | 10/1982 | Anderson et al. | 105/248 |
| 4,353,560 | A | | 10/1982 | Tohill | 277/236 |
| 4,353,668 | A | | 10/1982 | Anderson | 406/90 |
| 4,360,295 | A | | 11/1982 | Anderson | 406/76 |
| 4,361,096 | A | | 11/1982 | Funk | 105/248 |
| 4,362,111 | A | | 12/1982 | Stark et al. | 105/247 |
| 4,384,730 | A | | 5/1983 | Diehl | 277/236 |
| 4,428,585 | A | | 1/1984 | Dugge | 277/12 |
| 4,444,123 | A | | 4/1984 | Smith et al. | 105/377 |
| 4,455,947 | A | | 6/1984 | Reeve et al. | 105/377 |
| 4,466,558 | A | | 8/1984 | Dugge et al. | 222/195 |
| 4,484,528 | A | | 11/1984 | Anderson et al. | 105/248 |
| 4,484,852 | A | | 11/1984 | Anderson | 414/525 |
| 4,498,400 | A | | 2/1985 | Vorwerk et al. | 105/248 |
| 4,535,996 | A | * | 8/1985 | Cardis et al. | 277/1 |
| 4,568,224 | A | | 2/1986 | Dugge et al. | 406/90 |
| 4,594,948 | A | | 6/1986 | Smith et al. | 105/359 |
| 4,598,646 | A | | 7/1986 | Dugge et al. | 105/248 |
| 4,617,868 | A | | 10/1986 | Wahlstrom et al. | 105/282 |
| 4,644,871 | A | | 2/1987 | Arrey et al. | 105/4 |
| 4,662,543 | A | | 5/1987 | Solimar | 222/195 |
| 4,677,917 | A | | 7/1987 | Dugge et al. | 105/248 |
| 4,718,795 | A | | 1/1988 | Dugge | 406/30 |
| 4,768,684 | A | | 9/1988 | Dugge | 222/542 |
| 4,846,377 | A | * | 7/1989 | Fix et al. | 222/195 |
| 4,867,073 | A | | 9/1989 | Dugge | 105/358 |
| 4,880,148 | A | * | 11/1989 | Schmidt | 222/195 |
| 4,884,511 | A | | 12/1989 | Hallam et al. | 105/247 |
| 4,884,723 | A | | 12/1989 | Dugge | 222/542 |
| 4,898,101 | A | | 2/1990 | Harter | 105/247 |
| 4,902,215 | A | | 2/1990 | Seemann, III | 425/406 |
| 5,000,358 | A | | 3/1991 | Dugge | 222/502 |
| 5,052,906 | A | | 10/1991 | Seemann | 425/112 |
| 5,073,259 | A | | 12/1991 | Solimar | 210/232 |
| 5,139,175 | A | | 8/1992 | Krysel et al. | 222/195 |
| 5,236,287 | A | | 8/1993 | Dugge et al. | 406/145 |
| 5,238,333 | A | | 8/1993 | Dugge et al. | 406/145 |
| 5,248,227 | A | | 9/1993 | Hidock et al. | 406/41 |
| 5,259,322 | A | | 11/1993 | Dominguez et al. | 105/4.1 |
| 5,263,421 | A | | 11/1993 | Lichey et al. | 105/248 |
| 5,304,922 | A | * | 4/1994 | Betz et al. | 324/158 |
| 5,316,462 | A | | 5/1994 | Seemann | 425/112 |
| 5,355,809 | A | | 10/1994 | Dugge | 105/424 |
| 5,400,718 | A | | 3/1995 | Theurer et al. | 105/239 |
| 5,433,559 | A | | 7/1995 | Vande Sande | 406/145 |
| 5,657,700 | A | | 8/1997 | Bounds | 105/311.1 |
| 5,975,539 | A | * | 11/1999 | Ueda et al. | 277/593 |
| 6,200,465 | B1 | * | 3/2001 | Carawan et al. | 210/94 |

OTHER PUBLICATIONS

ACF Shippers Car Line Div., Operating & Service Manual, "Center Flow Pressureaide, Pressure Differential Car." 1962 ACF Industries, Inc., 1982.

GATX Operating Manual, "Power–FLO", No date.

AAA Manual of Standards and Recommended Practices, Section C, Car Construction Fundamentals and Details, 1979.

Patent application USSN 09/294,728 "*Pressure Discharge Railway Hopper Car*" (Attorney's docket: 091078.0621), Filed Apr. 19, 1999.

Patent application USSN 09/295,237, "*Large Capacity Car Body for Pressure Discharge Railway Hopper Cars.*" (Attorney's docket: 091078.0656), Filed Apr. 19, 1999.

Trademark Power FLO, Reg. No. 1,543,426, registered Jun. 13, 1989.

* cited by examiner

FIG. 10
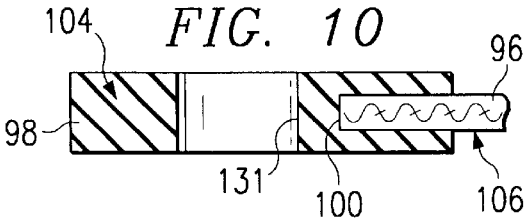
FIG. 11
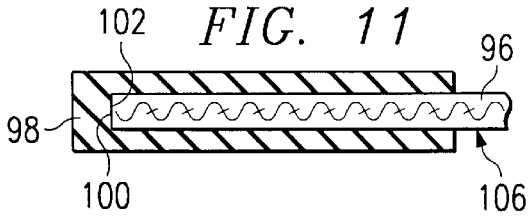
FIG. 12
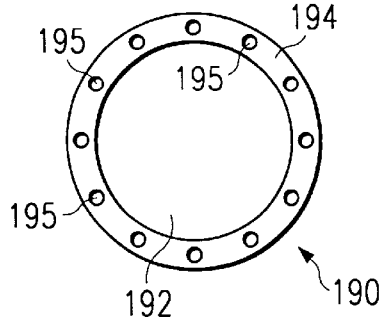
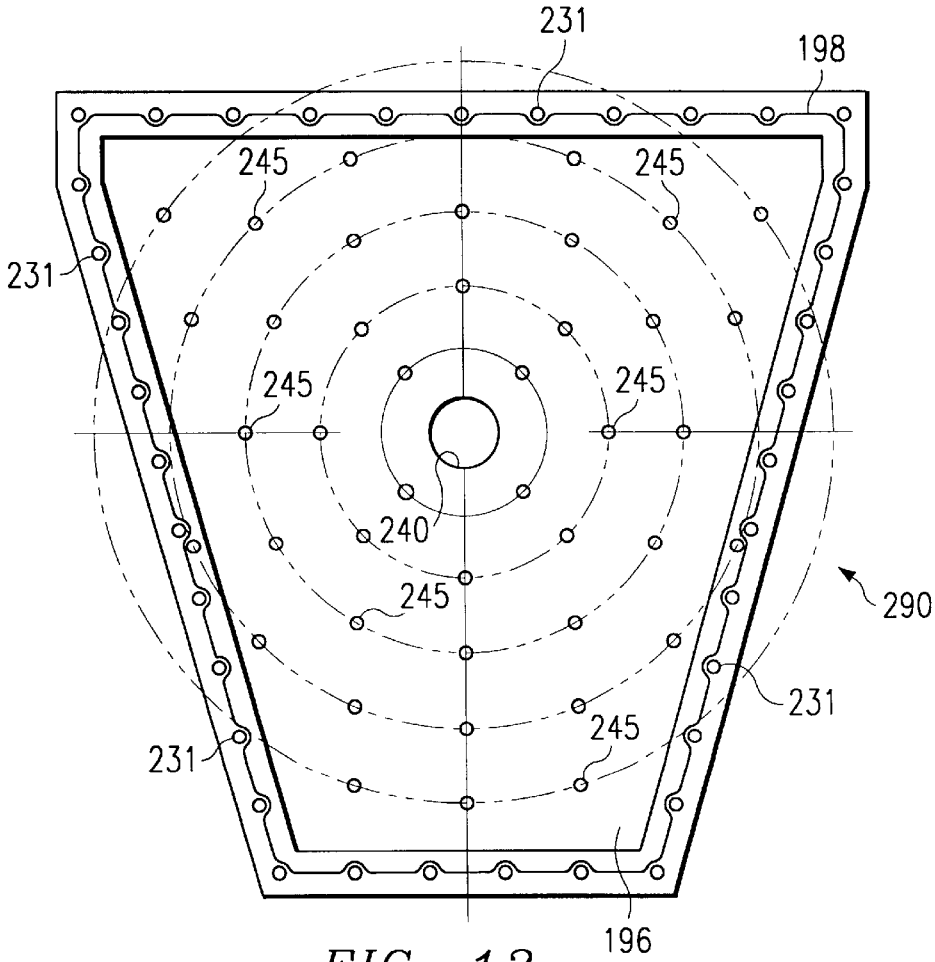
FIG. 13

AERATOR PAD ASSEMBLY FOR RAILWAY HOPPER CARS

RELATED PATENT APPLICATION

This application claims the benefit of U.S. Provisional Application No. 60/125,371, filed Mar. 18, 1999, and entitled "Aerator Pad Assembly for Railway Hopper Cars".

TECHNICAL FIELD OF THE INVENTION

The present invention relates generally to permeable membrane sealing apparatus and, more particularly, to an aerator pad assembly for railway hopper cars.

BACKGROUND OF THE INVENTION

Closed railway hopper cars with pneumatic systems for unloading are used for the transportation of powdered and granular products. For cars with positive pressure pneumatic systems, air may be supplied from an external source to pressurize the interior of the car body and simultaneously fluidize the dry, bulk product carried within the car to enable it to be conveyed in a fluidized state through product transfer conduits from the car to a collection facility. Air pressure within the hopper car during unloading is typically maintained at approximately fifteen pounds per square inch gauge pressure.

Aerator tub assemblies are often installed adjacent to a discharge opening for each hopper of a railway hopper car. The aerator tub assemblies sometimes incorporate aerator pad assemblies, including an aeration fabric and elastomeric gasket. Fasteners used to secure the aerator pad assembly generally require openings in the aerator pad assembly for proper installation. These openings often provide a path for air to escape from the pressurized hopper car. Consequently, the air pressure within the hopper car is often reduced and/or performance of the discharge system may be diminished.

SUMMARY OF THE INVENTION

In accordance with the teachings of the present invention, disadvantages and problems associated with fabrication, assembly and use of aerator pad assemblies have been substantially reduced or eliminated.

One embodiment of the present invention provides an aerator pad assembly having an aeration pad with a perimeter and a number of cutouts. The aeration pad may include a number of reinforcing supports providing additional strength and durability. A gasket may be disposed about the perimeter, the gasket having a plurality of protuberances with fastener openings disposed therethrough, and the protuberances preferably cooperate with the cutouts to form a continuous interface therebetween. In one embodiment, a notched opening within the gasket is provided at a generally continuous interface with the perimeter of the aerator pad at least partially occupying a portion of the notched opening.

In a particular embodiment, the gasket may be molded onto the aeration pad. In another embodiment, an adhesive material may be used to bond or attach the gasket with the aeration pad. In yet another embodiment, stitches of thread may attach the gasket and the aeration fabric pad. A sealant material may also be provided at the generally continuous interface to seal any voids between the gasket and the aeration pad.

Technical advantages of the present invention include an aerator pad assembly which reduces or eliminates leak paths between components of a railway hopper car. Another technical advantage includes increasing the strength of the aeration pad by placing the reinforcing supports thereon. Yet another technical advantage includes the increased length of the generally continuous interface provided by the perimeter of the aeration pad, which facilitates a stronger bond between the fabric or material used to form the aeration pad and the associated gasket. Still another technical advantage includes the various sizes and configurations of aerator pad assemblies available within the teachings of the present invention, allowing a wide variety of uses, for example pneumatic and filtration systems.

BRIEF DESCRIPTION OF THE DRAWINGS

For a more complete understanding of the present invention, and the advantages thereof, reference is now made to the following brief descriptions, taken in conjunction with the accompanying drawings and detailed description, wherein like reference numerals represent like parts, in which:

FIG. 10 is a schematic drawing showing a cross-section taken along line 10—10 of FIG. 9;

FIG. 11 is a schematic drawing showing a different cross-section taken along line 11—11 of FIG. 9;

FIG. 12 is a schematic drawing showing an alternative embodiment of an aerator pad assembly incorporating teachings of the present invention; and FIG. 13 is a schematic drawing showing another alternative embodiment of an aerator pad assembly incorporating teachings of the present invention.

DETAILED DESCRIPTION OF THE INVENTION

The preferred embodiments of the present invention and its advantages are best understood by referring now in more detail to FIGS. 1–13 of the drawings, in which like numerals refer to like parts.

Figure 1:
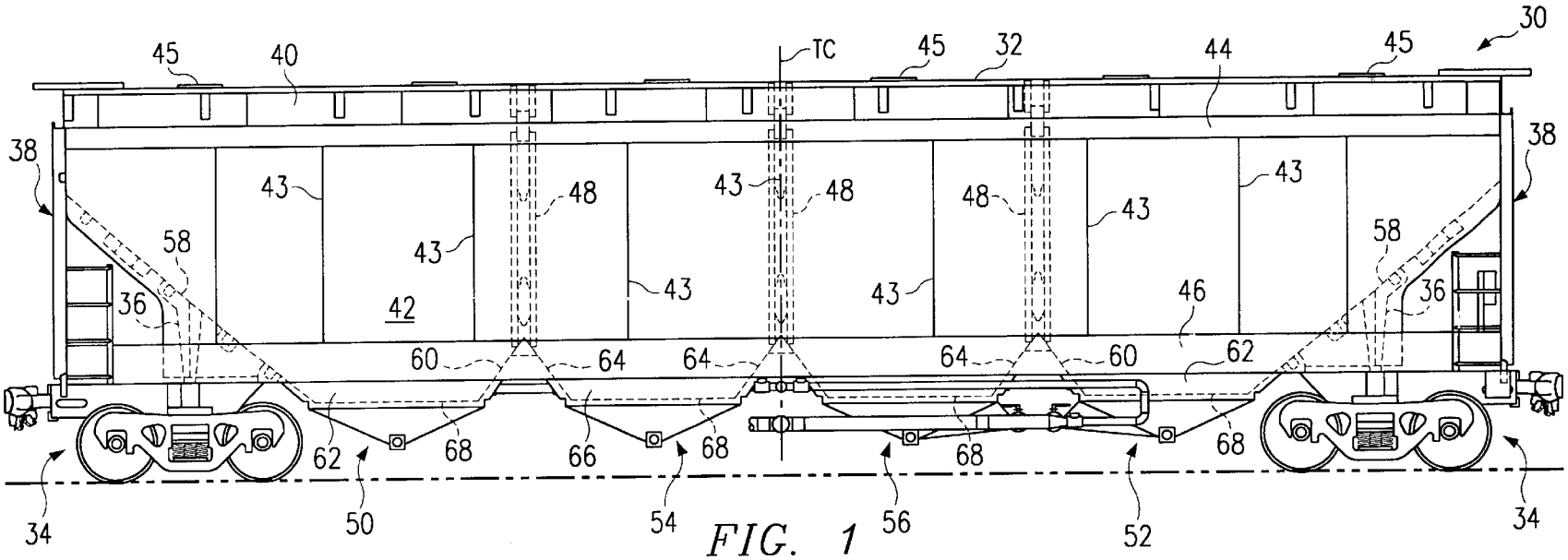
FIG. 1 is a schematic drawing, with portions broken away, showing a side view of a railway hopper car, incorporating aspects of the present invention.
Figure 2:
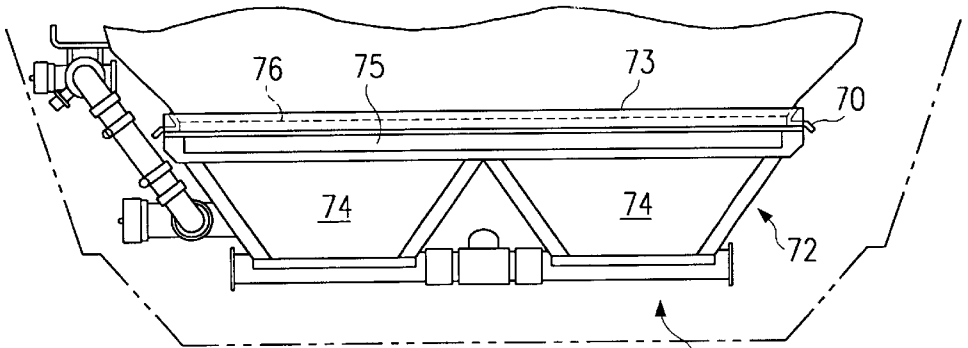
FIG. 2 is a schematic drawing, with portions broken away, showing a partial end view of an aerator tub assembly suitable for use with the railway hopper car of FIG. 1.
Figure 3:
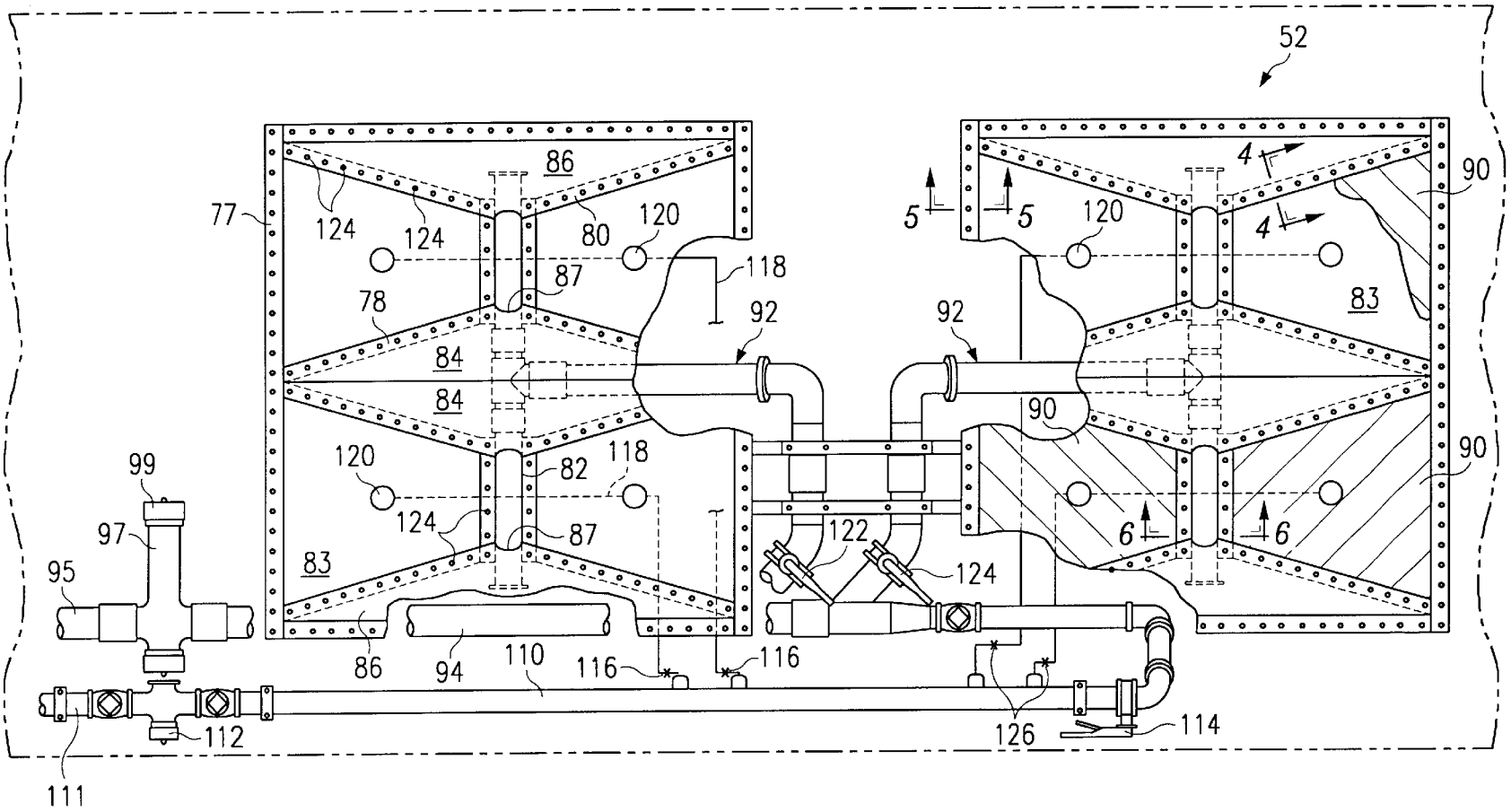
FIG. 3 is a schematic drawing, with portions broken away, showing a cross-sectional top view of components of the railway hopper car of FIG. 1.

A railway hopper car generally indicated by the reference numeral 30, is illustrated in FIGS. 1 and 2. Car 30 has a body 32 which is supported at each end on trucks 34 by bolsters 36 incorporated into end structures 38 of body 32. Body 32 is generally symmetrical about transverse centerline TC of car 30. A top sheet 40 and side sheets 42, form a partially enclosed container. Side sheets 42 consist of curved plates butt-welded at junctures 43. Similarly, top sheet 40 consists of curved plates butt-welded at junctures not explicitly shown. Car 30 is loaded via covered hatches 45 installed in top sheet 40. Channel-shaped top cords 44 and bottom cords 46 extend along each upper and lower edges of body 32. Crossridge frames 48 support top sheet 40 and side sheets 42.

For the embodiment shown in FIG. 1, railway hopper car 30 has four hoppers 50, 52, 54, and 56. Front and rear hoppers 50 and 52 are formed in part by end slope plates 58 of car 30, end structures 38, transverse slope plates 60 and hopper side skirts 62. Center hoppers 54 and 56, which adjoin each other at transverse center line TC, are formed in part by transverse slope plates 64 and side skirts 66. Each hopper 50, 52, 54, and 56 has a rectangular discharge opening 68 at its lower end, discharge openings 68 being of similar size and shape and each being defined by a perimeter frame 70.

Referring to FIGS. 2–6, an aerator tub assembly 72 may be bolted to frame 70 of each hopper 50, 52, 54 and 56, and each aerator tub assembly 72 includes a top opening 73. Top opening 73 is defined in part by a peripheral top frame 76, coextensive with discharge opening 68 of the respective hopper. Frame 76 may be fabricated from specially formed angle sections, the legs of which are preferably attached to frame 70. In another embodiment, aerator tub assembly 72 may be welded to frame 70. Each aerator tub assembly 72 associated with hopper car 30 is preferably identical, and each aerator tub assembly 72 includes a plenum 75 and four aerator units 74 associated therewith.

Aerator units 74 are defined in part by inner and outer side slope panels 84 and 86 and aeration panels 83. Aeration panels 83 are coupled with side support angles 78 and 80 associated with side slope panels 84 and 86, respectively, with a number of mechanical fasteners 150. Aeration panels 83 are also coupled to support angle 77 of plenum 75 with additional mechanical fasteners 150. Transverse support angles 82 are attached to branch discharge piping 92 and secured to aeration panel 83 with round head mechanical fasteners 152 which do not obstruct outlet opening 88 of discharge piping 92.

Air inlets 120 are provided within aeration panels 83 to facilitate the introduction of pressurized air or gas into car 30. In the illustrated embodiment, one air inlet is provided within each aeration panel 83. As discussed in more detail with respect to FIG. 7, one or more aerator cone assemblies 128 may also be incorporated into aeration panel 83, as desired, to enhance the performance of the system during unloading.

In the illustrated embodiment, panels 84 and 86 are oriented at approximately fifty-five degrees with respect to a horizontal axis (not expressly shown). The slope of panels 84 and 86, and the elliptical cutouts 87 disposed therein allow granular and powdered products to slide down panels 84 and 86 under the force of gravity, to the outlet opening 88 located at the bottom of each aerator unit 74. Since car 30 is symmetrical about transverse centerline TC, and aerator tub assemblies 72 function similarly, the operation of hoppers 52 and 56 will be described in detail, for illustrative purposes.

Outlet openings 88 communicate with branch discharge piping 92 to provide a conduit for unloading the contents of aerator units 74. Branch discharge piping 92 is coupled with main discharge piping 94, which carries the contents of hopper car 30 downstream to product discharge piping 97. Product outlet 99 is sealed during transport and later connected to additional piping (not expressly shown) in order to transport the product to a collection facility.

As mentioned previously, car 30 may be loaded with a bulk product (not expressly shown) which is typically in a powdered or granular state. Once the final destination is reached, car 30 may be unloaded quickly and easily according to the following sequence.

Compressed air or other suitable gas is provided to railway hopper car 30 through main air supply line 110 by connecting an air source at fitting 112. In one embodiment, a flex hose or flex connection may be accomplished at fitting 112 in order to introduce air into car 30. In order to unload hoppers 52 and 56, with control valve 114 in the closed position, air is introduced to main air supply line 110. When ball valves 116 are opened, air will charge branch air supply lines 118. Air will enter railway hopper car 30 through air inlets 120, and the pressure within railway hopper car 30 can be increased to a predetermined level, for example, fourteen and seven tenths pounds per square inch. Once this is accomplished, butterfly valve 122 within discharge piping 92 may be opened to allow product to flow through discharge piping 92 and into main discharge piping 94, for downstream collection. To enhance the flow of product through discharge piping 92 and 94, control valve 114 may be opened during the discharge procedure to provide a supply of air downstream of the flow of product as hopper car 30 is unloaded. Typically a pressure differential of 2 to 3 psi is maintained between railway hopper car 30 and main discharge piping 94. This ensures the flow of product will remain continuous during unloading. Control valve 114 may be pre-set and/or modulated to maintain this difference in pressure.

Hopper 52 may be unloaded in a similar manner, by sealing ball valves 116 and butterfly valve 122 and opening ball valves 126 and butterfly valve 124. Similarly, hoppers 50 and 54 may be unloaded using main air supply line 111 and main discharge piping 95.

In order for the system to operate efficiently, the interior components of railway hopper car 30 must be properly sealed, including the associated discharge piping and valves. Aerator pad assemblies 90 provide a generally fluid tight seal between components of aerator tub assemblies 72, and facilitate the introduction of air into hopper car 30 in a clean and efficient manner. Aerator pad assemblies 90 may be installed upon each aeration panel 83 to seal the joint between respective components, and to allow the flow of fluid through aerator pad assembly 90, without allowing the contents of car 30 to become lodged within air inlet 120.

Figure 4:
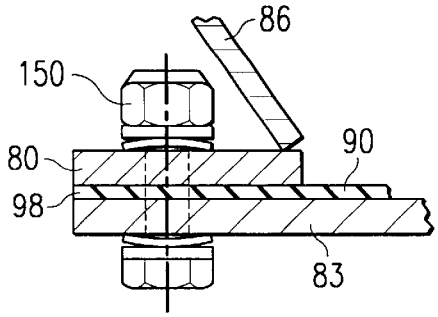
FIG. 4 is a schematic drawing, illustrating a cross-sectional view taken along line 4—4 of FIG. 3.
Figure 5:
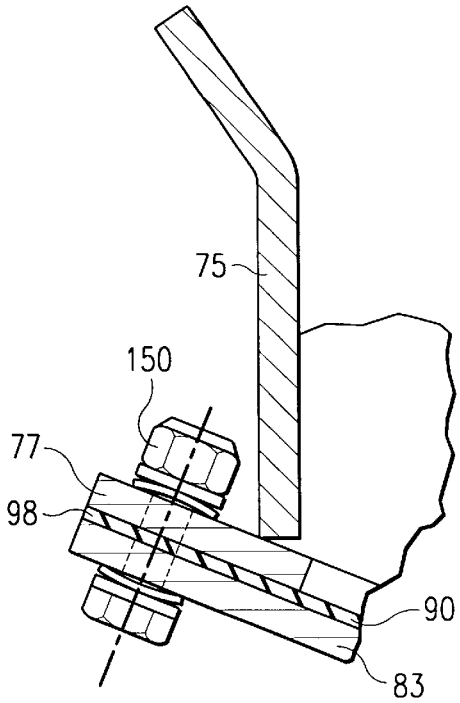
FIG. 5 is a schematic drawing illustrating a cross-sectional view taken along line 5—5 of FIG. 3.
Figure 6:
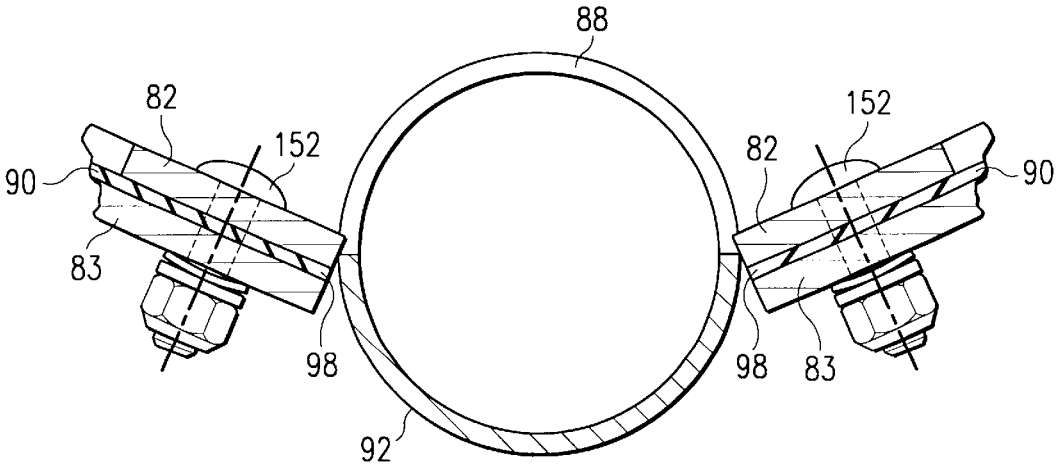
FIG. 6 is a schematic drawing illustrating a cross-sectional view taken along line 6—6 of FIG. 3.

As illustrated in FIGS. 4–6, aerator pad assembly 90 occupies the area between aeration panel 83 and respective support angles 78, 80, 77 and 82. A gasket 98 associated with aerator pad assembly 90, to be discussed in more detail with reference to FIG. 9, forms a fluid tight seal between aeration panel 83 and support angles 78, 80, 77 and 82. Aerator pad assembly 90 is held in place in part by fasteners 150 and 152, and partially due to the compression between aerator pad assembly 90 and support angles 77, 78, 80 and 82.

Figure 7:
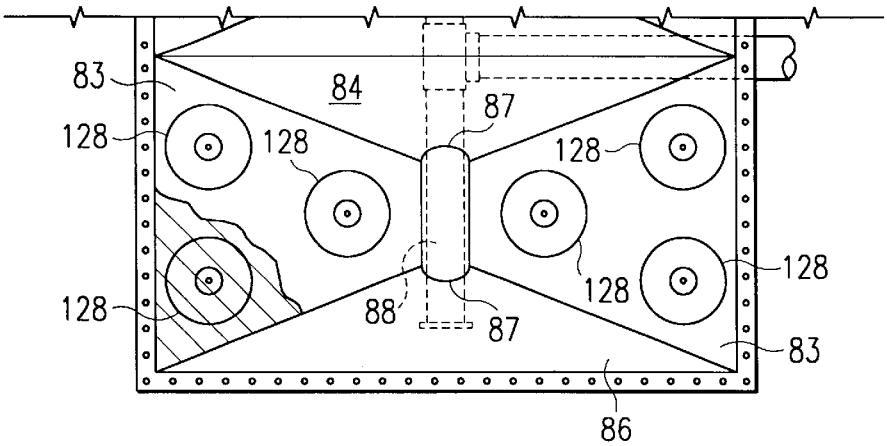
FIG. 7 is a schematic drawing, with portions broken away, showing an alternative configuration of an aerator panel, suitable for use within the teachings of the present invention.
Figure 8:
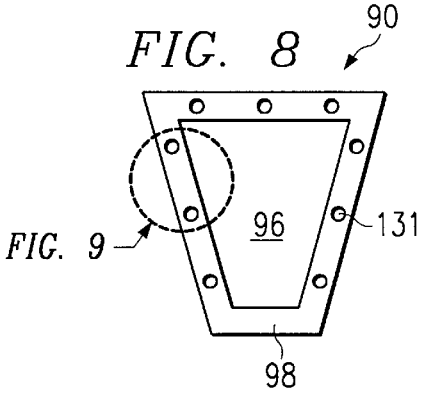
FIG. 8 is a schematic drawing showing an aerator pad assembly incorporating aspects of the present invention.
Figure 9:
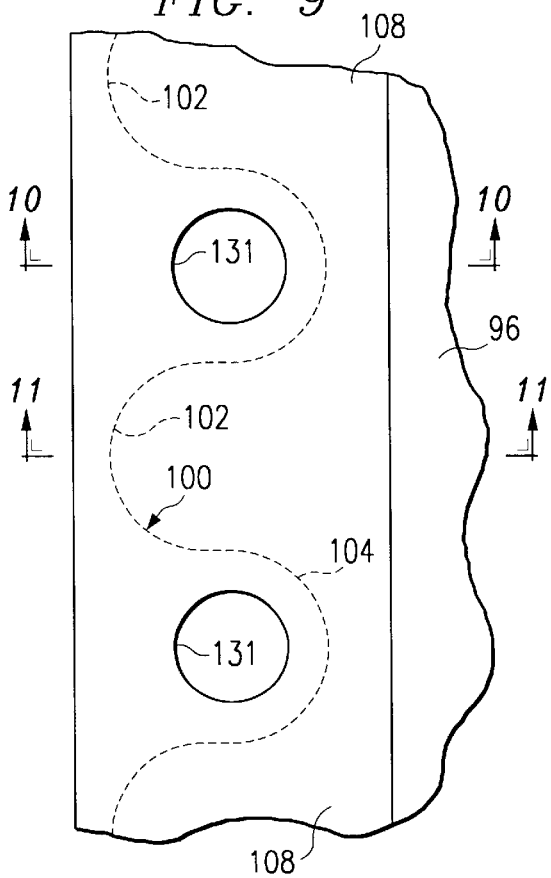
FIG. 9 is a schematic drawing showing portions of the aerator pad assembly of FIG. 8.

Referring to FIG. 7, one or more aerator cone assemblies 128 may be provided within aeration panels 83 or units 70 to distribute the air flow through air inlets 120 more effectively and promote fluidization of product within hopper car 30. Flow cones as manufactured by SureSeal and Solimar are suitable for use within the teachings of the present invention. Additional information regarding Solimar's Flowcone is available in U.S. Pat. No. 4,662,543. It will be recognized by those skilled in the art that the size, number, shape and configuration of air inlets and/or aerator cone assemblies associated with aeration panel 83 may be significantly modified within the teachings of the present invention.

Referring now to FIGS. 8–11, aerator pad assembly 90 includes an aeration pad 96 which is preferably formed from material or fabric which will allow pressurized fluid to pass therethrough, but block solid materials, including the product within railway hopper car 30 cannot pass therethrough. Aeration pad 96 covers the interior portion of aerator pad assembly 90. Aeration pad 96 may be formed from fabric specifically selected with a woven density appropriate to prevent granular or powdered product which may be carried in hopper car 30 from passing therethrough. Other materials and fabrics are suitable for use in forming aeration pad 96, provided the specific fluid contained within supply lines 118 may pass through, and the product within car 30 will not.

A gasket 98 is preferably disposed about the perimeter of aeration pad 96 to provide suitable surfaces for forming a fluid tight seal between aerator panel 83 and corresponding surfaces of support angles 77, 78, 80 and 82. In the illustrated embodiment, elastomeric material used to form gasket 98 is preferably selected to allow suitable compression to form an airtight seal between metal components of aerator tub assembly 72 at a pressure in excess of fifteen pounds per square inch. For example, gasket 98 may be formed from a white, FDA approved food-grade polymer with a durometer of 50–60. Other suitable compressible materials are available to form gasket 98. For some applications, gasket 98 may be designed for pressure in excess of fifteen pounds per square inch and a fluidizing agent other than air may be utilized.

Aeration pad 96 at least partially occupies a portion of notched opening 106 of gasket 98. Notched opening 106 allows aeration pad 96 to be "tucked" into gasket 98 forming an overlap therebetween. The size of notched opening 106 may be altered for various configurations. For instance, notched opening 106 may be provided with a wider and/or deeper dimension when a stronger bond is required. Depending upon the particular fastening technique used to join gasket 98 and aeration fabric pad 96, adhesives, joint fillers, and/or sealants may be introduced into notched opening 106 to strengthen the bond, and prevent the formation of leak paths.

Aeration pad 96 includes perimeter 100 with a number of generally semicircular cutouts 102 contained therein. Cutouts 102 are sized and configured to ensure that aeration pad 96 does not intersect any portion of fastener openings 131. Cutouts 102 form a gasket material/fabric interface with a number of protuberances 104, formed within gasket 98, extending therefrom. In the illustrated embodiment, cutouts 102 are a generally semicircular configuration. Various other configurations for cutouts 106 are available for use within the teachings of the present invention, provided aeration pad contact with fastener opening 131 is avoided.

The semicircular configuration of cutouts 106 increases the overall length of perimeter 100 of aeration pad 96 which provides a greater interface between gasket 98 and aeration pad 96. Depending upon the fastening technique used to couple gasket 98 and aeration pad 96, this may provide an advantage for the strength of the connection, and also minimize the vulnerability to leaks. For instance, if gasket 98 and aeration pad 96 are sewn together, this configuration provides a longer seam for stitching, which increases the strength of the bond. Similarly, if an adhesive material is used, the semicircular configuration provides a greater surface area to apply adhesive, thereby forming a stronger bond.

Protuberances 104 in gasket 98 provide a location for fastener openings 131 to avoid overlap of aeration pad 96 and fastener openings 131. In this manner, any fasteners, including mechanical fasteners 150 and 152, may be placed through openings 131 without penetrating or damaging the integrity of aeration pad 96. This eliminates any potential leak path which could form through which pressurized air would escape if aeration pad 96 joined fastener opening 131 directly. Accordingly, the designed interface between any aeration fabric which incorporates a boundary gasket will not allow the leakage of air at this interface to any area outside car 30. This facilitates the formation of a pressure vessel defined by components of car 30. The teachings of the present invention eliminate any leakage of air on either side of the gasket surface including a direction transverse through the fabric and out through fastener holes.

In one embodiment, gasket 98 may be molded directly onto aeration pad 96 to form a single integral aerator pad assembly 90. Alternatively, gasket 98 may be extruded and secured to aeration pad 96. Many methods of securing aeration pad 96 with gasket 98 may be utilized within the teachings of the present invention. In one embodiment, an adhesive material (not expressly shown) may be placed within notched opening 106 to secure aeration pad 96 with gasket 98. In another embodiment, one or more threads may be sewn through gasket 98 and aeration pad 96 to hold fabric 96 in place. In yet another embodiment, a sealant material may be applied to the interface of the aeration fabric and the gasket to fill and seal any voids present therebetween. The sealant material may be utilized in combination with any of the aeration pad and gasket fastening techniques.

An alternative embodiment of an aerator pad assembly incorporating teachings of the present invention is illustrated in FIG. 12. Aerator pad 190 is generally circular in shape and includes aeration pad 192 with gasket 194 molded thereto. Fastener opening 195 are provided for attaching aerator pad assembly 190 to components of a railway hopper car. Aeration pad 192 is preferably molded to gasket 194 such that aeration pad 192 does not overlap fastener opening 195.

There are many additional benefits to be derived from the teachings of the present invention. The molding process may be used to form a gasket on and into the fibers of the fabric or material used to form the associated aeration pad, thereby making the gasket an integral part of the aeration pad. Accordingly, the perimeter of the aeration pad may be shaped into nearly any configuration as desired for a particular application. Furthermore, the present invention allows the elimination of aeration pads in areas where mechanical fasteners and/or fastener openings are provided. By segregating the aeration pad and the fastener holes, leakage from transverse air movement through the aeration pad is minimized or eliminated. The molding process also removes the need to fasten the gasket and the aeration pad together.

Although the illustrated embodiment incorporates cutouts 102 in aeration pad 96 to accommodate fastener openings 131, cutouts 102 are not required. Similarly, protuberances 104, formed at the interface with cutouts 102 are not specifically required within the teachings of the present invention. If the width of gasket 98 is sufficient to completely surround fastener opening 131, and aeration pad 96 does not contact fastener opening 131, then potential leak paths are reduced and the efficiency of the seal between components is enhanced.

Another embodiment of aerator pad assembly 290 is illustrated in FIG. 13. Aerator pad assembly 290 includes aeration pad 196 and gasket 198 disposed therearound. Fastener openings 231 are provided for attaching aerator pad assembly 290 between components of a railway hopper car. Aerator pad assembly 290 incorporates reinforcing supports upon aeration pad 196. A central support 240 is provided near the center of aeration pad 196. Additional perimeter supports 245 are provided at various locations upon aeration pad 196. Supports 240 and 245 cooperate with each other to provide air flow paths under aeration pad 198 and prevent it from fully contacting aeration panel 83. Radial lines are included in FIG. 13 to illustrate one possible layout for supports 240 and 245. It will be recognized by those skilled in the art that many other configurations of supports 240 and 245 are available for use within the teachings of the present invention. For example, the size and location of all supports 240 and 245 may be varied significantly.

In another embodiment, one or more supports may be provided in the form of "strips" rather than the spot application shown. Furthermore, supports 240 and 245 may be provided in various materials. The illustrated embodiment incorporates an elastomeric material similar to gasket 98, to form supports 240 and 245. Other potential materials include strips of aeration pad.

The teachings of the present invention are equally applicable to many applications, including an aerator pad assembly for a railway hopper car. Many filtration devices requiring fluid flow therethrough will benefit from the aerator pad assembly of the present invention. This includes many liquid and gas filtration devices and pneumatic vehicle outlets wherein a gasket-type seal is desired between components.

Although the present invention has been described by several embodiments, various changes and modifications may be suggested to one skilled in the art. It is intended that the present invention encompasses such changes and modifications as fall within the scope of the present appended claims.

What is claimed is:

1. An aerator pad assembly, comprising:

an aeration pad with a plurality of cutouts forming a shaped perimeter of the pad;

a gasket disposed about the shaped perimeter, the gasket having a plurality of protuberances with fastener openings disposed therethrough, the protuberances sized to cooperate with the cutouts to form a generally continuous interface between the gasket and the pad;

a notched opening within the gasket at the generally continuous interface; and the shaped perimeter of the aeration pad at least partially occupying a portion of the notched opening.

2. The aerator pad assembly of claim 1, wherein the gasket is molded onto the pad.

3. The aerator pad assembly of claim 1, wherein the gasket and the pad are attached by an adhesive material.

4. The aerator pad assembly of claim 1, wherein the gasket and the pad are attached by stitches of thread.

5. The aerator pad assembly of claim 1, further comprising a sealant material applied to the generally continuous interface of the gasket and the pad to seal voids between the gasket and the pad.

6. The aerator pad assembly of claim 1, wherein the cutouts are generally semicircular in shape.

7. The aerator pad assembly of claim 1, wherein the gasket is formed from an elastomeric material.

8. The aerator pad assembly of claim 1, wherein the gasket is disposed between components of a railway hopper car to form a fluid tight seal therebetween.

9. The aerator pad assembly of claim 1, further comprising a plurality of reinforcing supports attached to the pad.

10. A railway hopper car having a plurality of hoppers with a pneumatic discharge system attached to each hopper, comprising:

an aerator pad assembly;

an aeration pad;

a gasket molded onto a perimeter of the pad; and the gasket having a plurality of fastener openings disposed therethrough with the openings located outside the perimeter of the pad.

11. The aerator pad assembly of claim 10, further comprising a sealant material applied to the perimeter of the pad to seal any voids between the gasket and the pad.

12. The aerator pad assembly of claim 10, further comprising a plurality of reinforcing supports attached to the pad.

13. The aerator pad assembly of claim 10, wherein the gasket is formed in part from a white, FDA approved, food grade polymer.

14. The aerator pad assembly of claim 10, wherein the gasket has a durometer of approximately 50–60.

15. A method for manufacturing an aerator pad assembly, comprising:

forming an aeration pad with a plurality of cutouts which define in part a shaped perimeter of the pad; and forming an elastomeric gasket corresponding generally with the shaped perimeter of the gasket and having a plurality of protuberances which cooperate with the cutouts to form a generally continuous interface between the gasket and the aeration pad; and forming a plurality of fastener openings disposed in and extending through respective protuberances.

16. The method of claim 15 further comprising attaching the gasket to the pad with an adhesive material.

17. The method of claim 15 further comprising stitching the gasket to the pad using thread.

18. The method of claim 15 further comprising applying sealant material to the shaped perimeter to seal voids between the gasket and the pad.

19. The method of claim 15 further comprising molding an elastomeric pad formed from a white, FDA approved, food grade polymer.

20. The method of claim 15 further comprising molding a gasket having a durometer of approximately 50–60.

* * * * *